United States Patent [19]

Budd

[11] Patent Number: 4,781,650

[45] Date of Patent: Nov. 1, 1988

[54] PROSTHETIC GARMENT FOR BILATERAL MASTECTOMY

[76] Inventor: Isabelle A. Budd, 2832 Innis Road, Gloucester, Ontario, Canada, K1B 4K4

[21] Appl. No.: 117,966

[22] Filed: Nov. 9, 1987

[30] Foreign Application Priority Data

Nov. 13, 1986 [CA] Canada ..... 522939

[51] Int. Cl.[4] ..... A41C 3/10

[52] U.S. Cl. ..... 450/55; 450/56; 450/30

[58] Field of Search ..... 450/55, 56, 58, 54, 450/79, 30; 2/51, 102, 109, 112, 113

[56] References Cited

U.S. PATENT DOCUMENTS

| | | | |
|---|---|---|---|
| 1,387,586 | 8/1921 | Bradford | 450/54 |
| 2,946,333 | 7/1960 | Morich | 450/58 |
| 3,565,081 | 2/1971 | Barg | 450/30 |
| 3,677,252 | 7/1972 | Pedley | 450/30 |
| 3,968,803 | 7/1976 | Hyman | 450/58 |
| 4,166,471 | 9/1979 | Griffin et al. | 450/54 |
| 4,295,469 | 10/1981 | Lindgren | 450/56 |
| 4,363,144 | 12/1982 | Goad . | |
| 4,369,792 | 1/1983 | Miller | 450/55 |
| 4,630,610 | 12/1986 | Fletcher | 2/51 X |

OTHER PUBLICATIONS

Airway Brochure, "The Portrait Group", pp. 15–19, date unkonwn.

*Primary Examiner*—Louis K. Rimrodt
*Assistant Examiner*—J. L. Olds
*Attorney, Agent, or Firm*—Karen M. Gerken; Martin P. Hoffman; Mitchell B. Wasson

[57] ABSTRACT

A light weight, fitted prosthetic garment comprising in combination a generally cylindrical body-encircling member on each side of the top front of the body-encircling member is a rounded flap corresponding to the two breast positions of the wearer; on the inside of each rounded flap is a pocket member for holding artificial breast members; attached at the top of each rounded flap is a shoulder strap each looped back and each attached at the rear of the body-encircling member, said shoulder straps being spaced at the rear at approximately the same distance apart as at the front of the garment.

6 Claims, 1 Drawing Sheet

PROSTHETIC GARMENT FOR BILATERAL MASTECTOMY

BACKGROUND TO THE INVENTION

This invention relates to an undergarment for women, and more particularly to a prosthetic garment that will give the bilateral mastectomy patient, that is, a woman who has had both breasts removed, a natural bust contour.

A particular object of this invention is to allow the bilateral mastectomy patient to engage in normal daytime activity while properly filling out the dress fashion of today. It is therefore the primary object of the present invention to provide a garment which, at all times, gives a natural contour to the female figure that has been altered by surgery.

The designers of prosthetic brassiers and other prosthetic undergarments have failed to appreciate that devices heretofore used have been objectionable in two respects. Firstly, prosthetic garments heretofore used have had an unnatural bulkiness, a variety of strapping devices, have been attendent with physical inconvenience and discomfort. Secondly, prosthetic garments heretofore used have a tendancy to rise up as the wearers of same engage in activity wherein the arms are raised above the shoulders. The various tightly fitting straps heretofore used on prosthetic devices do not allow those prosthetic devices heretofore available to return to an equilibrium position after physical activity, resulting in an unnatural bust contour as well as in physical discomfort to the wearer.

SUMMARY OF THE INVENTION

The present invention seeks to overcome these physical inconveniences and discomforts by having lightweight removable foam bust members fitting into a lightweight, fitted, garment which returns to an equilibrium position after physical activity ceases.

According to the present invention there is provided a light weight, fitted prosthetic garment comprising in combination a generally cylindrical body-encircling member on each side of the top front of the body-encircling member is a rounded flap corresponding to the two breast positions of the wearer; on the inside of each rounded flap is a pocket member for holding artificial breast members; attached at the top of each rounded flap is a shoulder strap each looped back and each attached at the rear of the body-encircling member, said shoulder straps being spaced at the rear at approximately the same distance apart as at the front of the garment.

Preferably in such a prosthetic garment, said cylindrical body-encircling member has a vertical fastening strip running from the top to the bottom at the front of the cylindrical body, whereby the wearer can place the garment round her body and fasten the same in a closed configuration, and remove the same.

A prosthetic device embodying the present invention does away with tightly fitting strapping devices, zippers, hooks and metallic or plastic material which result in discomfort to the wearer when such fastening elements come into contact with the flesh. Another advantage of the present invention is that the garment is fitted extremely low weight and hence comfortable to wear. The present invention is also pleasing in appearance, easily washable, and adapted to convenient and economical manufacture.

These and other objects and advantages of the present invention reside in the details of construction as more fully hereinafter described and claimed, references being to the accompanying drawing and description of one specific embodiment of the present invention which follows:

DETAILED DESCRIPTION OF THE INVENTION

Figure 3:
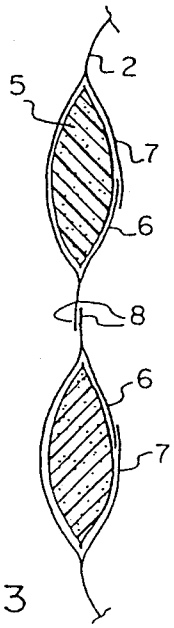
FIG. 3 illustrates an enlarged detail vertical view in section of the breast pockets and breast inserts, illustrating the manner in which said breast inserts are fitted into said breast pockets according to the present invention.
Figure 2:
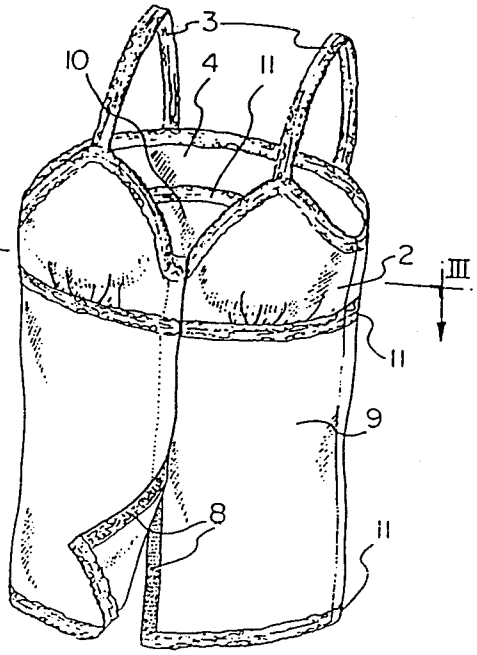
FIG. 2 illustrates a general front elevational view of a prosthetic garment according to the present invention.
Figure 1:
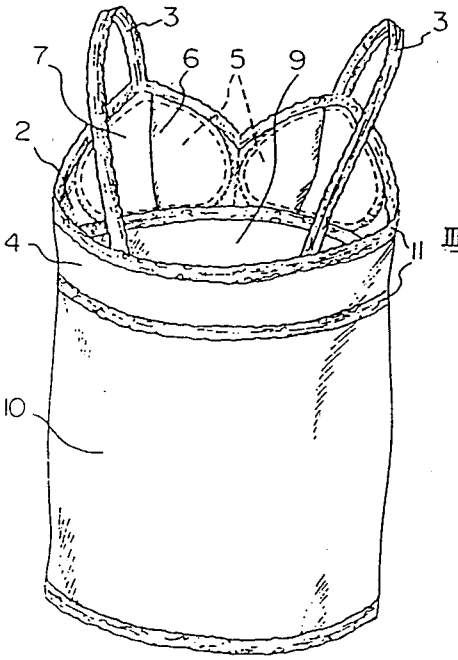
FIG. 1 illustrates a general rear elevational view of a prosthetic garment according to the present invention.

Referring more particularly to the drawings, FIGS. 1 and 2 generally illustrate a one piece garment which consists of four main panels, denoted by 2, 4, 9 and 10, of stretchy lingerie or stretchy cotton or some like material. The panels are secured together by means of lace material denoted by 11 or by stitching as between the vertical borders of panels 9 and 10. The garment includes a pair of breast pockets illustrated by FIG. 3, each breast pocket being connected at its upper portion to a shoulder strap denoted by 3, the strap 3 being connected at the other end to panel 4. Each breast pocket includes back panel members denoted by 6 and 7, somewhat overlapping, panel members 6 and 7 being secured along their upper, lower, and outside borders to panel 2, and along lower margin to panel 9.

The breast insert 5, which is preferably formed of bonded polyester or like material, is inserted in the pouch between front and cup panel 2 and back cup panels 6 and 7 through the overlapping open edge formed by cup panels 6 and 7. The apparent bust contour may be altered by placing breast inserts 5 of different sizes into the pouch. In addition, the removable breast insert padding permits separate washing of the padding and the garment.

The garment is closed together by means of a securing strip known in the trade under the trade mark Velcro. This consists of two strips of fabric, denoted by 8, each sewn to an opposing front face of the panel members 9. Each piece of fabric 8 has a pile which, when compressed into the pile of the other interlocks in the manner described in Canadian patent No. 520,129 of George de Mestral dated Dec. 27, 1958.

I claim as my invention:

1. A prosthetic garment comprising a generally cylindrical member defined by front and rear lightweight yieldable panel members stitched together to form a unitary garment adapted to generally encircle the upper torso of a wearer, said front panel member having an upper front member in the form of a pair of breast flaps adapted to correspond in location to the breasts of said wearer, said front panel member having a lower front member, said rear panel member having upper and lower rear members, the first of said breast flaps being connected to said upper member of said rear panel by a first strap member, the second of said breast flaps being connected to said upper member of said rear panel by a second strap member, each of said breast flaps having an internal panel generally corresponding in shape to the shape of said breast flaps and being secured thereto so as to define a pocket, an opening formed in said internal panel, said pocket being adapted to receive a breast insert inserted through said opening, said upper and lower front panel members being formed of opposing upper and lower panels adapted to be connected together generally at the center of said front panel by securing means.

2. The prosthetic garment recited in claim 1 wherein said front and rear panels are fabricated of a soft stretchy fabric.

3. The prosthetic garment recited in claim 1 wherein said first and second straps are connected to said respective breast flaps and said upper rear member by means of stitching.

4. The prosthetic garment recited in claim 1 wherein the spacing between said straps along said upper front panel is generally the same as the spacing between said straps along said upper rear panel.

5. The prosthetic garment recited in claim 1 wherein each of said internal panels comprises first and second internal panels, said first and second internal panels each having upper and lower edges and outer and inner side edges, said upper, lower and outer edges of each of said first and second internal panels being secured to a respective one of said breast flaps, said opening being formed between said inner side edges of said respective first and second internal panels.

6. The prosthetic garment recited in claim 1 wherein said securing means comprises a Velcro ® strip on each of said opposing front panels.

* * * * *